US006469708B1

(12) United States Patent
Wu et al.

(10) Patent No.: US 6,469,708 B1
(45) Date of Patent: Oct. 22, 2002

(54) IMAGE DITHERING DEVICE PROCESSING IN BOTH TIME DOMAIN AND SPACE DOMAIN

(75) Inventors: Tung-hai Wu, Taichung; Jen-chung Weng, Hsinchu; Kuei-hsiang Chen, Hsinchu; Jia-der Hsieh, Hsinchu, all of (TW)

(73) Assignee: Myson Technology, Inc. (TW)

( * ) Notice: Subject to any disclaimer, the term of this patent is extended or adjusted under 35 U.S.C. 154(b) by 0 days.

(21) Appl. No.: 09/492,261

(22) Filed: Jan. 27, 2000

(51) Int. Cl.[7] ..... G09G 5/02
(52) U.S. Cl. ..... 345/596; 345/597; 345/598
(58) Field of Search ..... 345/589, 590, 345/591, 596, 597

(56) References Cited

U.S. PATENT DOCUMENTS 5,881,178 A * 3/1999 Tsykalov et al. ..... 382/260
6,288,698 B1 * 9/2001 Ishii et al. ..... 345/87
6,330,368 B1 * 12/2001 Ulichney ..... 382/251

* cited by examiner

*Primary Examiner*—Matthew Luu
(74) *Attorney, Agent, or Firm*—Birch, Stewart, Kolasch & Birch, LLP

(57) ABSTRACT

An image dithering device processing in both time domain and space domain to improve the image quality of an LCD digital display is disclosed. The device comprises a Gamma Table for performing Gamma processing on input signals; a counter module for generating a row counting value and a column counting value by counting the vertical synchronizing signal, horizontal synchronizing signal, and image pixel clock of the LCD image control system; a dithering value generating module for providing a dithering value for each pixel according to the row counting value and the column counting value, the dithering value generating module having a matrix with different value; and a calculation module for performing calculation on the value output form the Gamma Table and the dithering value for decreasing the bits of the input image value so as to fit the input data bits of the LCD display. Since the abandoned lower bite data are expressed in terms of time domain, the image quality and color of the LCD digital display can be increased.

2 Claims, 4 Drawing Sheets

IMAGE DITHERING DEVICE PROCESSING IN BOTH TIME DOMAIN AND SPACE DOMAIN

BACKGROUND OF THE INVENTION

1. Field of Invention

The present invention relates to an LCD image dithering technology and, in particular, to an image dithering technology processing in both time domain and space domain to improve the image quality of the LCD.

2. Related Art

For an 18-bit liquid crystal display (LCD) panel, since its resolution is lower than that of a 24-bit full color image data and it can not display images with full color, its image quality must have a certain influence. The most serious one is that false edges appear in a smooth varying image plane. Therefore, there are related technologies for the image scaler to deal with such problems, for example, by dithering. In usual dithering technologies, noise signals are added into input signals before quantifying the input signals and removed after quantification. The signals with noise signals removed are the output signals.

However, ordinary dithering technologies focus on treatment in space domain, that is, the dithering is performed on the two dimensional images. Furthermore, there would be errors in the quantification and the image would become uneven.

SUMMARY OF THE INVENTION

In view of the foregoing, it is an object of this invention to provide an image processing device and method for the dithering technology with the combination of time domain and space domain so as to improve image quality.

It is another object of this invention to provide an image processing device and method with a dithering technology that combines both time domain and space domain and enhances the Gamma Table so as to improve image quality.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
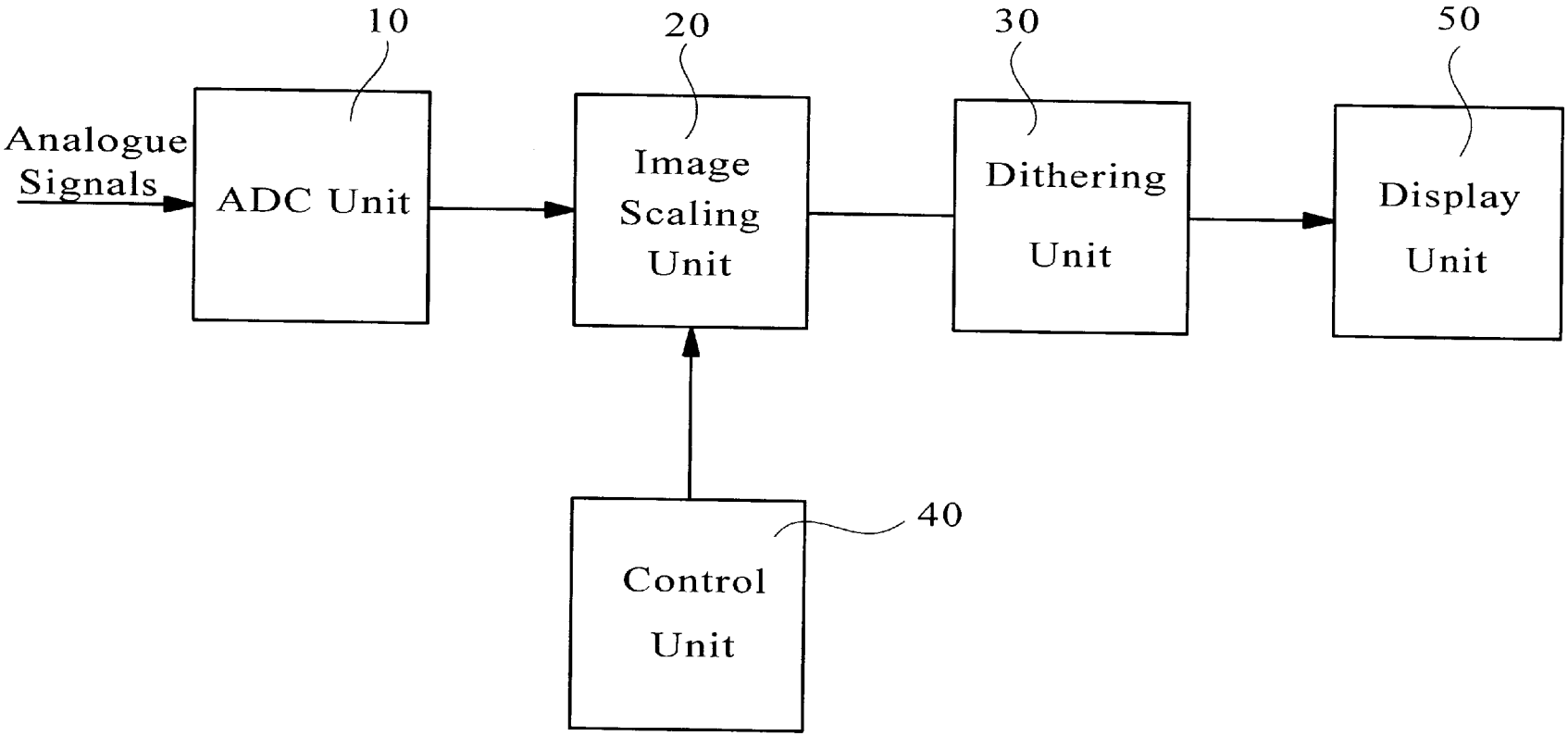
FIG. 1 is the image control structure of an ordinary LCD.

FIG. 1 is the image control structure of an ordinary LCD. As shown in the drawing, the LCD image control system comprises an analogue to digital converter (ADC) unit 10 for converting analogue image signals into digital ones; an image scaler unit 20 for interpolating digital image signals for scaling up or scaling down; a dithering unit 30 for converting input data with more bits (e.g., 8 bits) into the ones with fewer bits (e.g., 6 bits) using the dithering technology in time domain and space domain and outputting the results to a digital display device 50; and a control unit 40 for controlling the actions of the ADC unit 10, the image scaler unit 20, and the dithering unit 30.

Figure 2:
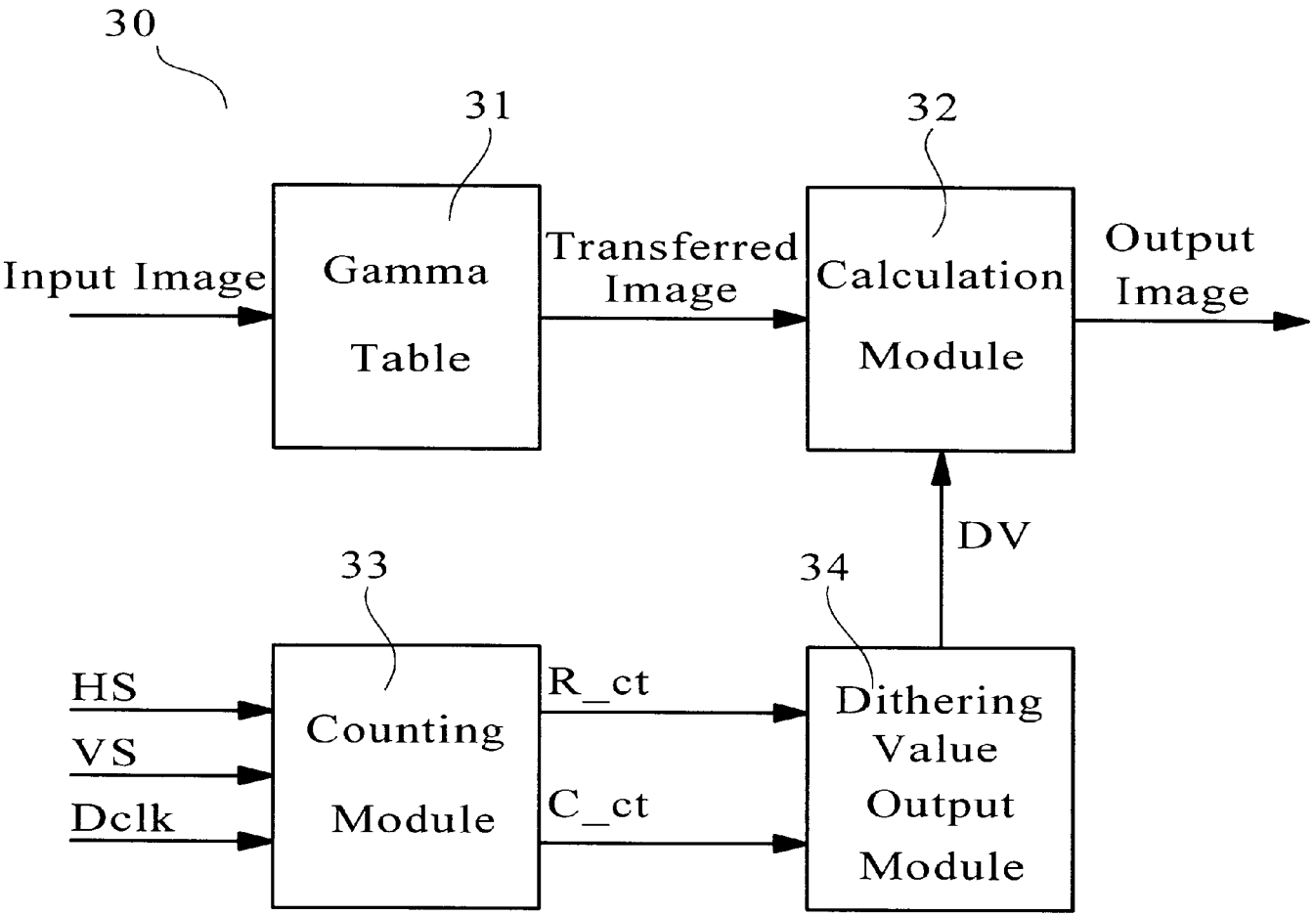
FIG. 2 is a structural diagram of the dithering, technology according to the present invention.

FIG. 2 shows the hardware structure of a dithering unit 30 according to the present invention. The dithering unit 30 comprises a 10-bit Gamma Table 31, a calculation module 32, a counter module 33, and a dithering value output module 34. The key point in the dithering technology is on how to generate a two dimensional white noise pattern. The dithering unit 30 employs a 4×4 dithering matrix. To prevent the error on original data due to the conversion by the Gamma Table 31 and increase the image quality, the dithering unit 30 uses a 10-bit Gamma Table 31 instead of the conventional 8-bit Gamma Table. After the conversion by the Gamma Table 31, the original 8-bit data become 10-bit data.

As shown in FIG. 2, the dithering unit 30 uses the counter module 33 to generate a row counting value R_ct and a column counting value C_ct according to the vertical synchronizing signal VS, horizontal synchronizing signal HS, and pixel clock signal. The dithering matrix then outputs a dithering value DV according to the row counting value R_ct and the column counting value C_ct. The calculation module 32 performs calculations on the 10-bit images converted by the Gamma Table and the dithering value DV, and outputs 6-bit output images to achieve the dithering effect.

The dithering matrix is a 4×4 matrix stored with 16 different numbers of 4-bit integer data, as the matrix data shown in Table 1. The output of the dithering matrix is controlled by the row counting value R_ct and the column counting value C_ct generated by the counter module 33. To ensure a homogeneous distribution, the dithering matrix elements are in the order shown in Table 1. The dithering matrix contains values ranging from 0 to 15. Such organization is arranged so that the sum of the elements in any 2×2 sub-matrix of the dithering matrix is 30, except that two 2×2 sub-matrix have the sum 26 and 34, respectively.

TABLE 1

| One example of the dithering matrix | | | |
|---|---|---|---|
| 7 | 14 | 5 | 12 |
| 9 | 0 | 11 | 2 |
| 4 | 13 | 6 | 15 |
| 10 | 3 | 8 | 1 |

Figure 3:
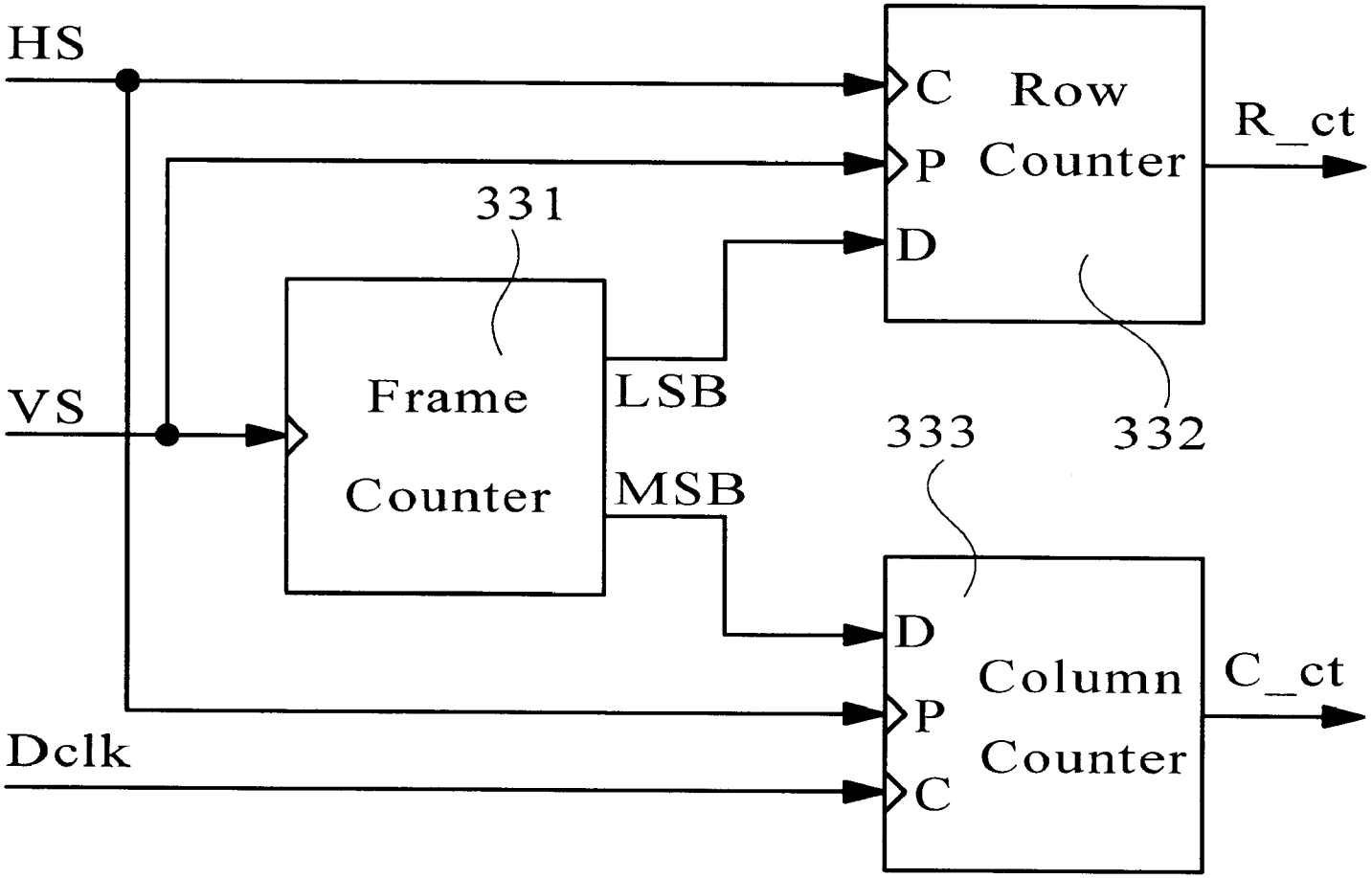
FIG. 3 is a block diagram of the counter module shown in FIG. 2.

FIG. 3 is a block diagram of the counter module 33. As shown in the drawing, the counter module 33 comprises a frame counter 331, a row counter 332, and a column counter 333. The row counter 332 is a 2-bit counter in this embodiment. It is added by 1 at the trigger of each horizontal synchronizing signal HS, and outputs a row counting value R_ct. The column counter 333 is also a 2-bit counter in this embodiment. It is added by 1 at the trigger of each pixel clock pulse Dclk, and outputs a column counting value C_ct. Moreover, to achieve the dithering effect, the dithering unit 30 also employs a 4-bit frame counter 331 to change the default values of the row counter 332 and the column counter 333. The frame counter 331 is added by 1 at each trigger of the vertical synchronizing signal VS. The column counter 37 is initialized with the higher 2-bits data of the frame counter 331 at each HSYNC active region; while the column counter 37 is initialized with the lower 2-bits data of the frame counter 331 at each VSYNC active region. In such manner, every 16 image frames form a cycle. The output of the dithering value output module 34 is related to the position and frame of the pixel. So this achieves at the same time the dithering in both time domain and space domain.

Figure 4:
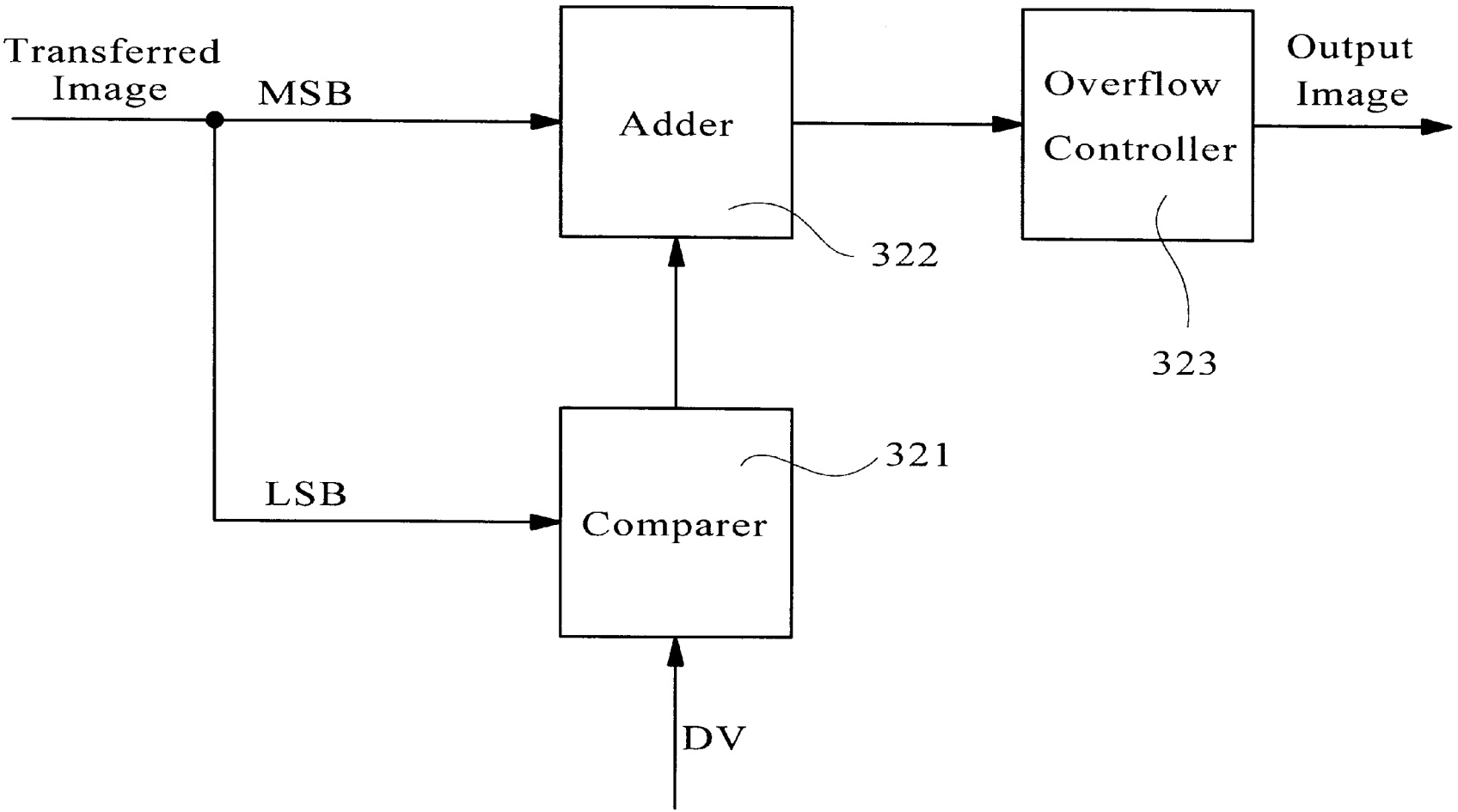
FIG. 4 is a block diagram of the calculation module shown in FIG. 2.

Please refer to FIG. 4, which is a block diagram of the calculation module 32. As shown in the drawing, the calculation module 32 comprises a comparer 321, an adder 322, and an overflow controller 323. The comparer 321 performs the subtraction of the lower bits of the converted image and the dithering value, and outputs the carrying value to the adder 322. In this embodiment, the lower bits of the converted image contain 4 bits, which are the same as the bits in the dithering value DV. The adder 322 is then used to do the addition of the higher bits of the converted image and the carrying value from the comparer 321, and outputs the result and overflow value to the overflow controller 323. In this embodiment, the higher bits of the converted image contain 6 bits, which are the same as the input signal bits of the display unit 50. When the overflow controller 323 receives the result from the adder 322, if the adder 322 generates a carrying value, the overflow controller 323 outputs a default overflow value which is usually the maximum of the output data, such as 3F for 6 bits. If the adder 322 does not generate any carrying value, then the overflow controller 323 outputs the addition result of the adder 322.

Since the output values of the dithering matrix go one cycle for every 16 image frames, each pixel in the images would be calculated with the output values included by the dithering matrix and ranging from 0 to 15 in these 16 frames. Suppose a fixed pixel in the image is on the left upper comer, the output value is 7, as shown in Table 2. There would be 7 frames out of the 16 frames that cause the comparer 32 to generate a carrying value of 1. Therefore, the average carrying value of the 16 frames is 7/16. Although data in the lowest 4 bits are abandoned, yet the frequency of the occurrence of carrying over and the influence of persistence of vision, the color information stored in the abandoned bits can be compensated.

TABLE 2

An example of the dithering output values

| Frame | DV | Carrying value |
|---|---|---|
| 0 | 7 | 0 |
| 1 | 14 | 0 |
| 2 | 5 | 1 |
| 3 | 12 | 0 |
| 4 | 9 | 0 |
| 5 | 0 | 1 |
| 6 | 11 | 0 |
| 7 | 2 | 1 |
| 8 | 4 | 1 |
| 9 | 13 | 0 |
| 10 | 6 | 1 |
| 11 | 15 | 0 |
| 12 | 10 | 0 |
| 13 | 3 | 1 |
| 14 | 8 | 0 |
| 15 | 1 | 1 |
| Average carrying value | | 7/16 |

As described above, the image dithering device with the combination of time domain and space domain according to this invention uses the characteristic of persistence of vision to re-express abandoned data in terms of time domain. This makes the output image quality and color from the LCD superior than the unprocessed image. Furthermore, its design is simple but useful.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims. For example, though this specification proposes a 10-bit Gamma Table to replace the conventional 8-bit Gamma Table and uses a 4×4 dithering matrix to perform dithering, yet a 9-bit or 11-bit Gamma Table and a 3×3 or 5×5 dithering matrix can be employed to perform dithering. Or one may even choose to work with an 8-bit Gamma Table and a 2×2 dithering matrix.

What is claimed is:

1. An image dithering device processing in both time domain and space domain for the application in an LCD image control system, which device comprises:

a Gamma Table for performing Gamma processing on input signals;

a counter module for generating a row counting value and a column counting value by counting the vertical synchronizing signal, horizontal synchronizing signal, and image pixel clock of the LCD image control system, comprising:

a frame counter for generating a frame value by counting the vertical synchronizing signal;

a row counter for generating the row counting value by counting the horizontal synchronizing signal, and the row counter loading in the lower bits of the frame value as preset value when triggered by the vertical synchronizing signal; and a column counter for generating the column counting value by counting the pixel clock, and the column counter loading in the higher bits of the frame value as default value when triggered by the horizontal synchronizing signal;

a dithering value generating module for providing a dithering value for each pixel according to the row counting value and the column counting value, the dithering value generating module having a matrix with different value; and a calculation module for performing calculation on the value output from the Gamma Table and the dithering value for decreasing the bits of the input image value so as to fit the input data bits of the LCD display, comprising:

a comparer for performing the subtraction of the lower bits data inputted into the calculation module and the dithering value, and outputting a carrying value;

an adder for performing the addition of the higher bits data inputted into the calculation module and the carrying value output from the comparer, and outputting a sum and an overflow value; and an overflow controller for receiving the sum and the overflow value of the adder and outputting the sum or a maximum value according to the overflow value.

2. The image dithering device of claim 1, wherein if the overflow value is LOW, then the overflow controller outputs the sum.

* * * * *